US006553946B1

(12) United States Patent
Abraham et al.

(10) Patent No.: US 6,553,946 B1
(45) Date of Patent: Apr. 29, 2003

(54) MULTI-FUNCTION WATER HEATER CONTROL DEVICE

(75) Inventors: Anthony W. Abraham, Laguna Niguel, CA (US); Raymond-Paul Joubran, Pasadena, CA (US)

(73) Assignee: Roberrshaw Controls Company, Richmond, VA (US)

( * ) Notice: Subject to any disclaimer, the term of this patent is extended or adjusted under 35 U.S.C. 154(b) by 69 days.

(21) Appl. No.: 09/591,440

(22) Filed: Jun. 9, 2000

(51) Int. Cl.[7] ..... F24H 9/20

(52) U.S. Cl. ..... 122/14.22; 122/14.31; 122/448.1

(58) Field of Search ..... 122/13.01, 14.2, 122/14.22, 14.3, 14.31, 17.1, 17.2, 448.1; 126/360.1

(56) References Cited

U.S. PATENT DOCUMENTS

| | | | | |
|---|---|---|---|---|
| 1,789,547 A | * | 1/1931 | Hahn | 236/25 A |
| 4,346,835 A | | 8/1982 | Trotter et al. | |
| 4,505,253 A | | 3/1985 | Mizuno et al. | |
| 4,531,509 A | | 7/1985 | Wilhelm, Jr. | |
| 4,641,631 A | | 2/1987 | Jatana | |
| 4,770,161 A | | 9/1988 | Charron | |
| 4,823,770 A | | 4/1989 | Loeffler | |
| 5,083,705 A | * | 1/1992 | Kuze | 236/34.5 |
| 5,085,579 A | | 2/1992 | Moore, Jr. et al. | |
| D326,712 S | | 6/1992 | Fabrizio | |
| 5,179,914 A | | 1/1993 | Moore, Jr. et al. | |
| 5,357,907 A | | 10/1994 | Moore, Jr. et al. | |
| 5,479,558 A | | 12/1995 | White, Jr. et al. | |
| 5,499,621 A | | 3/1996 | Trihey | |
| 5,544,645 A | | 8/1996 | Armijo et al. | |
| 5,636,598 A | | 6/1997 | Moore, Jr. | |
| 5,735,237 A | | 4/1998 | Phillip et al. | |
| 5,754,090 A | * | 5/1998 | Arensmeier | 337/123 |
| 5,832,947 A | | 11/1998 | Niemczyk | |
| 5,875,739 A | | 3/1999 | Joyce | |

* cited by examiner

*Primary Examiner*—Jiping Lu
(74) *Attorney, Agent, or Firm*—Blackwell Sanders Peper Martin LLP

(57) ABSTRACT

A single control device is operational to control the flow of gas to a water heater as well as to protect against excessive temperature and pressure. The control device requires only a single fitting to be attached to the water heater tank to expedite the assembly process, eliminate a number of potential sources of leakage and reduce heat loss.

17 Claims, 2 Drawing Sheets

MULTI-FUNCTION WATER HEATER CONTROL DEVICE

BACKGROUND OF THE INVENTION

The present invention is generally directed to control devices for gas-fired water heaters and more particularly pertains to gas flow control valves as well as safety mechanisms that guard against the build-up of excess heat and/or pressure within water heaters.

Gas fired water heaters typically rely on a gas valve that controls the flow of gas to the burner in order to maintain the temperature of the water contained in the tank within preselected limits. As the water temperature drops below a preselected lower limit, the valve opens to permit the flow of gas to the burner where it is ignited by a pilot flame or electronic means. When the temperature of the water exceeds a preselected upper limit, the valve shuts off the flow of gas. Such temperature regulation is typically achieved with the use of a temperature sensor that must be immersed in the water within the tank and therefore requires the wall of the tank to be penetrated. In common use is an Invar rod type sensor which extends through the tank wall into the water contained therein, wherein the distal end of an Invar rod is affixed to the distal end of a concentrically positioned copper sleeve. The disparate rates of thermal expansion of the two materials causes the proximal ends of the rod and sleeve to undergo relative movement which is advantageously employed to open and close the gas valve.

Water heaters are usually additionally fitted with a pressure relief (PRV) valve that serves to vent water from within the tank should it exceed a preselected pressure. Such safety device prevents a build up of excessive pressures that could cause catastrophic failure of the tank. When the water pressure exceeds the preselected limit, the PRV valve opens to relieve excessive pressure to a vent line that conducts the released water to a safe location. The fitting of a PRV valve inherently requires another penetration of the tank wall.

Water heaters are typically also protected against the build up of excessive temperatures with the use of a relief valve that is actuated by a temperature sensor. The sensors in common use must be immersed in the water and therefore another penetration of the tank wall is required. Such device may be combined with the pressure relieve valve wherein a single valve mechanism is actuatable by either the temperature sensor or directly by water pressure thereby achieving both functions with a single perforation of the water tank.

Another device fitted to most water heaters is a drain valve that allows the water to be drained from the tank. This is necessary to enable the tank to be moved or to be flushed. The valve is typically located near the bottom of the tank in an easily accessible location.

A disadvantage of the prior art approach to the use of these various control and safety devices is inherent in the fact that each requires a separate hole to be formed in the water heater tank, the welding of a threaded fitting thereto and the threading of the respective device thereinto. Not only is such manufacturing process relatively labor intensive, but the mounting of each of such device then poses a potential for leakage throughout the service life of the water heater. Additionally, each device that protrudes from the tank not only serves as a conduit for heat loss but may also serve to disrupt the continuity of insulation that is fitted about the tank to further compromise the ability of the water heater to retain heat. Finally, the protrusion of these various devices through the outer skin of a water heater is unsightly which may be problematic for installations wherein the water heater is positioned in plain sight.

It would therefore be advantageous to reduce the number of devices that must be attached to a water heater in order to properly and safely control its operation. Such improvement would expedite the assembly process, reduce the potential for leaks and reduce heat loss to improve the overall efficiency of the water heater.

SUMMARY OF THE INVENTION

The present invention overcomes the disadvantages associated with prior art control and safety devices utilized on water heaters. The control device of the present invention may integrate any combination of the gas flow control valve actuator, pressure relief valve, temperature relief valve and drain cock in a single housing that requires only a single fitting to be attached to the tank. This greatly reduces the potential for leakage, reduces manufacturing costs, reduces heat loss to improve the overall efficiency of the water heater and provides for a smoother, less cluttered outward appearance.

A preferred embodiment of the control device of the present invention employs an Invar rod mechanism to sense water temperature and actuate the gas valve. The interior of the housing through which the Invar rod extends from the gas valve into the interior of the tank is in fluid communication with the tank. A port is formed in such housing which is sealed off by a relief valve that is biased against a valve seat by a spring. The spring is oriented and configured such that in the event the water pressure within the tank and hence within the housing rises to a level that overcomes the biasing action of the spring, the relief valve opens to release water through the port. The force of the spring may also be overcome by manual means so as to enable the same relief valve to be used as a drain cock. A temperature sensor also manipulates the relief valve. A temperature in excess of a preselected amount causes the spring tension to be overcome and the valve to open. The same valve is therefore used to manually drain the tank as well as to automatically reduce excessive water temperature or pressure.

These and other features and advantages of the present invention will become apparent from the following detailed description of a preferred embodiment which, taken in conjunction with the accompanying drawings, illustrates by way of example the principles of the invention.

DETAILED DESCRIPTION OF THE PREFERRED EMBODIMENTS

The control device of the present invention controls the temperature and pressure of the water contained in a water heater. The device controls the operation of a gas valve that regulates the flow of gas to the burner to heat the water and automatically opens a relief valve in the event the internal pressure or temperature of the tank exceeds certain limits. Additionally, the device allows the tank to be manually drained there through. As a result only a single hole must be formed in the tank to accommodate all of these various functions.

Figure 3:
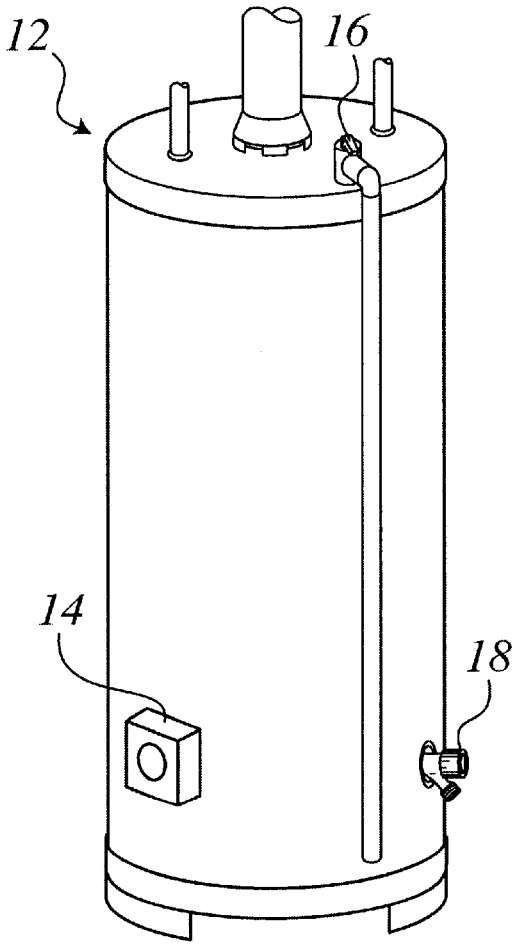
FIG. 3 (PRIOR ART)
FIG. 3 is a perspective view of a water heater fitted with prior art devices.

FIG. 3 illustrates a prior art water heater 12, having a separate gas control valve 14, a combination pressure and temperature relief valve 16 and a drain cock 18. Each such component is tapped into the interior of the tank necessitating a separate hole forming operation, welding operation and assembly operation during the manufacture of the water heater. In addition to being unsightly, each component contributes to heat loss as each such component conducts and radiates heat and compromises the continuity of any insulation in place about the tank.

Figure 4:
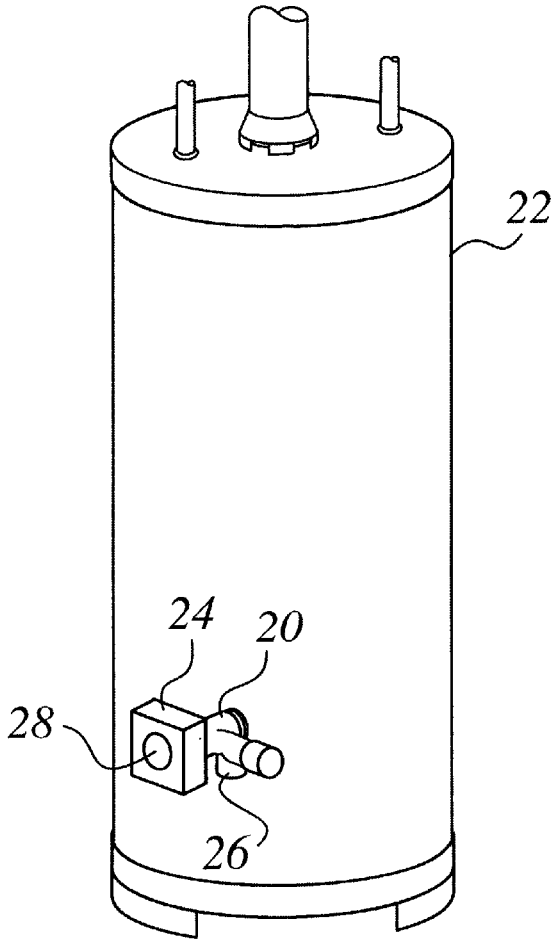
FIG. 4 is a perspective view of a water heater fitted with the control device of the present invention.

FIG. 4 illustrates the control device 20 of the present invention in place on a water heater 22 and coupled to a gas flow valve 24. The control device includes a single exit port 26 through which water is automatically drained in the event excessive temperature or pressure within the tank is sensed or when it is desired to manually drain the tank. The desired water temperature is set by rotation of the dial 28 associated with the gas flow valve.

Figure 1:
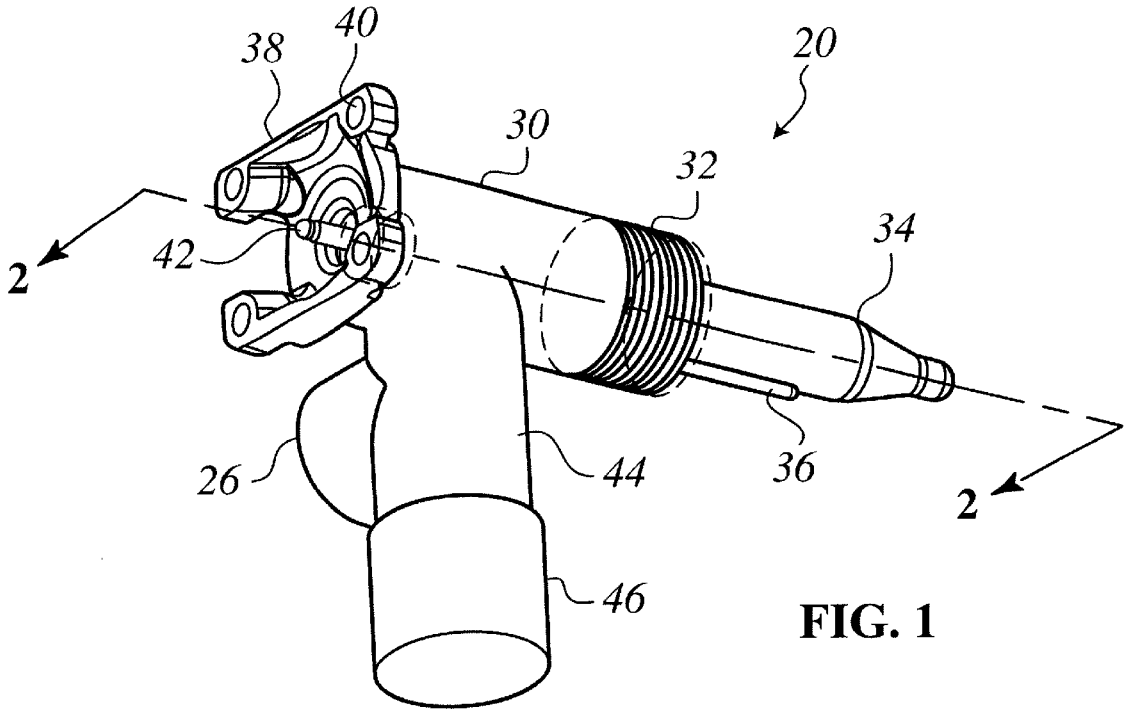
FIG. 1 is an enlarged perspective view of a preferred embodiment of the control device of the present invention.

FIG. 1 is enlarged perspective view of the control device 20 of the present invention which is shown detached from the water heater and from the gas control valve. The control device includes a housing 30 having a threaded end 32 for threaded receipt in the water heater. Visible extending from the threaded end is a first temperature sensor 34 for the control of the gas valve and a second temperature sensor 36 for the operation of the relief valve. A mounting flange 38 is disposed directly opposite the threaded end is configured to attach to the gas valve. In this particular embodiment, a square flange has four holes 40 holes formed therein for receiving fasteners that engage the gas valve. The proximal end of an Invar rod 42 is visible extending from the interior of the housing. A lateral branch 44 of the housing includes the exit port 26 and supports a rotatable control knob 46.

Figure 2:
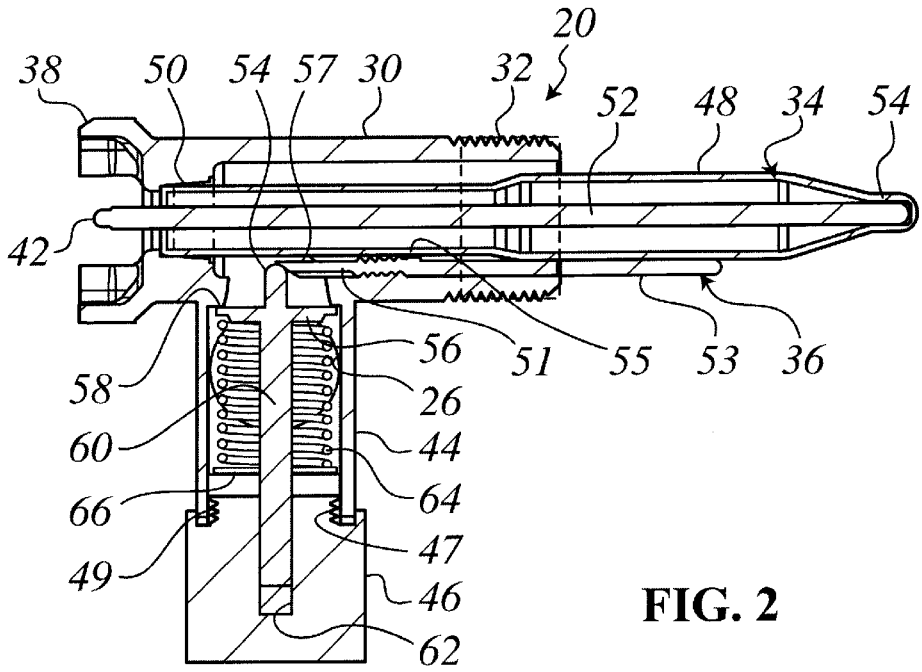
FIG. 2 is a cross-sectional view taken along line 2—2 of FIG. 1.

FIG. 2 is a cross-sectional view taken along lines 2—2 of FIG. 1 illustrating the various internal components of the control device 20. Temperature sensor 34 includes a copper sleeve 48 that is rigidly attached to the housing 30 at it proximal end 50. The Invar rod 52 extends through the interior of the sleeve and is rigidly attached thereto at its distal end 54. The disparate coefficients of thermal expansion of the sleeve and rod cause the proximal end 42 of the Invar rod 52 to move relative to the mounting flange 38 as the sensor is heated or cooled. The proximal end thereby effectively functions as a plunger which is employed to open and close the conventional gas valve (not shown) to which the control device is fastened. Alternatively, a wax pellet type temperature sensor may be used in place of the Invar rod type sensor. Such sensor relies on the expansion of a small amount of paraffin contained within a metallic housing against a piston or plunger as its temperature increases. The sensor and housing may be configured such that the plunger acts directly on the gas valve or a mechanism may be relied upon to transfer motion from the sensor to the gas valve.

The lateral branch 44 of the housing 30 encloses a valve mechanism that includes a valve head 56 that seals against a valve seat 58. A valve stem 60 extends from the head and is carried in a bore 62 formed in control knob 46. The receipt of the valve in the bore serves to maintain the valve in alignment within the housing but allows longitudinal movement. The valve head is biased against the valve seat by valve spring 64 which is in turn constrained by retainer 66. The exertion of sufficient force on the face of the valve head will cause the valve to lift off its seat to thereby set the interior of the housing into fluid communication with the interior of the lateral branch of the housing. A flow path is thereby created through the entire control device. Water entering the housing through the threaded end flows in the space between the interior of the housing and exterior of sensor 34, past the opened valve into the interior of the branch component and out through port 26.

The valve may alternatively be opened by rotating control knob 46 so as to back it out of the housing. The lateral branch has internal threads 47 formed therein which cooperate with threads 49 formed on the knob. Rotation of the knob in a counterclockwise direction serves to shift the spring retainer 66 outwardly and enables the spring 64 to expand. By thereby relieving the force exerted by the spring on the valve, the valve is free to open.

The valve is additionally linked to temperature sensor 36. Such sensor employs a small quantity of paraffin contained within a rigid housing 53 that causes an actuation rod 51 received therein to extend outwardly as the temperature rises and the wax expands. A bored and threaded boss 55 formed on the interior wall of the valve housing 32 receives the threaded proximal end of the sensor housing 53 to positively maintain the sensor in position. The proximal end 57 of rod 21 defines an inclined plane that cooperates with the rounded proximal end 59 of the valve stem 60 to transfer axial movement of the rod to a raising or lowering of the valve 56. Heating the sensor beyond a preselected limit will cause its proximal end to extend sufficiently to thereby lift the valve off of its seat. Alternatively, an Invar rod type sensor may be employed in place of the described wax pellet type senor.

The attachment of the control device of the present invention to a water heater requires forming only a single hole in the water tank. A threaded fitting is welded thereto which receives the threaded end 32 of the housing 32. Both sensors 34, 36 are thereby caused to extend well into the tank and are thereby fully immersed in the water contained therein. A conventional gas control valve is fastened to the flanged end 38 of the housing 30 such that the proximal end 42 of the Invar rod is able to open and close the gas valve as it shifts inwardly and outwardly as a function of the water temperature. In the event the water temperature exceeds a preselected limit, the mechanism associated with the second temperature sensor serves to lift the valve 56 off of its seat 58 to enable water to escape via the exit port 26. The in rushing cold water that replaces the vented water quickly cools down the internal temperature of the water tank. Similarly, in the event a preselected water pressure is exceeded, the pressure bearing against the face of the valve 56 causes the force of spring 64 to be overcome and allows the valve to lift off of its seat. The escape of water immediately reduces the built up pressure while the in rushing cold water also cools the water tank to further reduce pressure. In the event it is desired to drain the tank, knob 46 is rotated to shift the retainer 66 outwardly and thereby relieve the closing force exerted on the valve.

While a particular form of the invention has been illustrated and described, it will also be apparent to those skilled in the art that various modifications can be made without departing from the spirit and scope of the invention. Accordingly, it is not intended that the invention be limited except by the appended claims.

What is claimed is:

1. A device for controlling the operation of a water heater wherein a gas flow control valve actuator and a water valve are integrated in a single housing that is attachable to said water heater via a single port formed in said water heater, and wherein said water valve is configured to open when water within said water heater exceeds a preselected pressure.

2. A control device for the operation of a gas-fired water heater, comprising:

a housing affixed to said water heater and in fluid communication therewith;

a first temperature sensor contained within said housing and extending into said water heater, operative to actuate a gas valve that controls the flow of gas to a burner for heating water contained in said water heater; and a water valve disposed in said housing operative to allow the release of water contained in said water heater.

3. The control device of claim 2, further comprising a second temperature sensor disposed within said housing and operative to open said water valve when the temperature of water within said water heater exceeds a preselected limit.

4. The control device of claim 3, further comprising a pressure sensor disposed within said housing and operative to open said water valve when the pressure of water within said water heater exceeds a preselected limit.

5. The control device of claim 4, wherein said water valve is manually actuatable.

6. The control device of claim 5, wherein said valve is manually actuatable by the rotation of an externally disposed knob.

7. The control device of claim 4, wherein said pressure sensor comprises a compression spring.

8. The control device of claim 3, wherein said second temperature sensor comprises a wax pellet type sensor.

9. The control device of claim 2, further comprising a pressure sensor disposed within said housing for actuating said water valve when the pressure of water exceeds a preselected limit.

10. The control device of claim 9, wherein said water valve is manually actuatable.

11. The control device of claim 2, wherein said water valve is manually actuatable.

12. The control device of claim 2, wherein said first temperature sensor comprises an Invar rod.

13. A method for controlling the temperature of water within a water heater, comprising the steps of:

forming a single opening in said water heater; and attaching to said opening a single housing having disposed therein a first temperature sensor operative to control a gas valve supplying gas to a burner for heating said water within said water heater and having further disposed therein a water valve for releasing said water from within said water heater.

14. The method of claim 13, wherein said single housing contains a second temperature sensor operative to open said water valve in the event the temperature of said water exceeds a preselected limit.

15. The method of claim 13, wherein said single housing contains a pressure sensor operative to open said water valve in the event the pressure of said water exceeds a preselected limit.

16. The method of claim 13, wherein said water valve is manually actuatable.

17. The method of claim 13, wherein said water valve is operable to release water from within said water heater when said water exceeds a preselected temperature, when said water exceeds a preselected pressure and when a knob disposed on the exterior of said housing is manually rotated.

* * * * *

UNITED STATES PATENT AND TRADEMARK OFFICE

CERTIFICATE OF CORRECTION

PATENT NO. : 6,553,946 B1
DATED : April 29, 2003
INVENTOR(S) : Abraham et al.

It is certified that error appears in the above-identified patent and that said Letters Patent is hereby corrected as shown below:

Title page,
Item [73], delete "Roberrshaw Controls Company" and replace with
-- Robertshaw Controls Company --;

Column 4,
Line 24, delete "21" and replace with -- 51 --.

Signed and Sealed this

Eleventh Day of November, 2003

JAMES E. ROGAN
*Director of the United States Patent and Trademark Office*